US006401325B1

(12) United States Patent
Fidtje

(10) Patent No.: US 6,401,325 B1
(45) Date of Patent: Jun. 11, 2002

(54) CONNECTING TOOL

(76) Inventor: Torbjørn Fidtje, Granittveien 9, N-4340 Bryne (NO)

( * ) Notice: Subject to any disclaimer, the term of this patent is extended or adjusted under 35 U.S.C. 154(b) by 0 days.

(21) Appl. No.: 09/647,929

(22) PCT Filed: Apr. 14, 1999

(86) PCT No.: PCT/NO99/00120

§ 371 (c)(1),
(2), (4) Date: Nov. 22, 2000

(87) PCT Pub. No.: WO99/53576

PCT Pub. Date: Oct. 21, 1999

(30) Foreign Application Priority Data

Apr. 14, 1998 (NO) ..... 981663
Apr. 14, 1998 (NO) ..... 981664

(51) Int. Cl.[7] ..... H01R 43/20
(52) U.S. Cl. ..... 29/566.4; 29/750
(58) Field of Search ..... 29/566.4, 566.3, 29/748, 750, 758, 751, 752, 566.1, 861, 564.4, 764; 140/93 R

(56) References Cited

U.S. PATENT DOCUMENTS 3,810,288 A * 5/1974 Caveney et al. ..... 29/564.4
4,052,788 A * 10/1977 Hastings ..... 29/764
4,716,651 A 1/1988 Klaiber et al. ..... 29/750
4,840,579 A 6/1989 Dvorak et al. ..... 29/861
5,099,570 A 3/1992 Gerhard, Jr. ..... 29/751
5,467,520 A * 11/1995 Nunez et al. ..... 140/93 R
5,613,297 A 3/1997 Dvorak et al. ..... 29/861

FOREIGN PATENT DOCUMENTS

| | | |
|---|---|---|
| DE | 2739247 | 8/1977 |
| EP | 0210945 A1 | 2/1987 |
| EP | 0279508 A1 | 8/1988 |
| GB | 1423062 | 1/1976 |
| WO | WO84/01671 | 4/1984 |

* cited by examiner

*Primary Examiner*—William Briggs
(74) *Attorney, Agent, or Firm*—Jacobson Holman, PLLC

(57) ABSTRACT

The present invention relates to a connecting tool substantially for use in wire connections (31) for electricity or signalling which have to be brought into contact in a connecting clamp (30). The connecting tool is provided with knife segments (12, 47*a,* 47*b,* 64) which, when the connecting tool is used, remove the insulation on a part of the wire connection (31) before it is brought into connection in a connecting clamp (30) by means of the connecting tool. The device consists of a housing (15, 16, 41, 60) with open cavities (8), in which cavities there is substantially permanently mounted a wire-pushing device (13, 43, 61) against which the wire connection (31) abuts, when the device is in use. In the housing's (15, 16, 41, 60) cavity (8) there are movably arranged one or more bodies (11, 46*a,* 46*b,* 63), on which movable bodies there are mounted substantially in the wire connection's (31) longitudinal direction two or more knife segments (12, 47*a,* 47*b,* 64) with a specific spacing.

14 Claims, 8 Drawing Sheets

CONNECTING TOOL

The present invention relates to a connecting tool substantially for use in association with wire connections for electricity or signalling which have to be brought into contact in a connecting clamp.

The connecting tool is provided with knife segments which, when the connecting tool is in use, remove the insulation on a part of the wire connection or displace parts of the insulation before the wire connection by connecting the connecting tool in a connecting clamp. The connecting tool can therefore be used both in association with uninsulated wire connections which have to be brought into connection in a connecting clamp, as well as insulated wire connections whose insulation has to be removed in an area before being brought into contact in a connecting clamp or the like.

Wire connections of various kinds are used for transferring electricity, data and telephone signals and the wire connections are terminated in contact points of different types depending on the area of application and the type of wire. The work of terminating wire connections in contact points is normally performed by a tradesman who is familiar with the existing requirements at any time concerning the wire's connection with a contact point. Thus it will be important for a tradesman to have available at all times the tools necessary for making a connection between a wire and a contact point which satisfies the existing requirements regarding connection, while being able to perform this task within a reasonable time and in an efficient manner. This is particularly important where several operations are necessary in order to make a connection between a wire and a contact point. The most common operations in this connection are to remove the insulation from the end of the wire after adapting the length and position of the wire, and subsequently to fit the stripped part of the wire in the contact point and secure the wire to the contact point.

There are at present a plurality of different types of contact points for use in transferring electricity, data signals, telephone signals and the like. Two main groups of such contact points, however, have different systems for connecting a wire connection.

A common type of connection is a screw connection where the stripped wire connection is mounted beside or partly round a screw which is then tightened, thus forming a secure connection between the screw, the earth connection in which the screw is mounted and the stripped part of the wire connection.

This type of wire connection requires a succession of operations which are relatively time-consuming and the quality of the result of the connection is entirely dependent on the skills of the tradesman. There is therefore every possibility that a screw connection may result in an unsatisfactory wire connection if, for example, the screw is not tightened sufficiently, or the stripped part of the wire is incorrectly mounted in connection with the screw. Moreover, screw connections are subject to change over time, particularly if the screw connection is performed in an operative environment, which, e.g., entails frequent or large temperature fluctuations, vibrations and dynamic loading, or if it is exposed to other influences on the material in the screw connection. The contact between the wire and the screw connection, e.g. when transferring electricity, will develop heat, and if the surrounding environment has a temperature which deviates significantly from the temperature in the screw connection during the transfer of electricity, the screw connection may lose its tension round the stripped wire. This may cause the intermediate resistance between wire and screw connection to increase, which in turn may lead to dangerous situations, both in connection with heat development in the contact and in connection with unsatisfactory contact. If the contact supplies important appliances with electricity or signals, poor contact and a possible break could lead to serious problems. Similarly, overheating and potential fire in the contact could also result in dangerous and serious situations. In order to overcome the said problem, the clamping force between the screw connection and the stripped wire must be kept constant and high enough to ensure a good connection with low intermediate resistance.

Alternatively, a clamp device may be employed as contact point where the stripped wire is pushed into an opening in an electrically conductive, preferably metallic material, which opening is adapted to the cross sectional dimension of the stripped wire, with the result that the clamp conveys an adequate clamping force to the wire. The use of such a clamp device is time-saving since fewer operations require to be performed in connection with the fitting of the stripped wire in the clamp. However, special tools have to be employed to push the wire into position in the clamp, particularly since the clamp has to be designed in such a manner that it conveys sufficient clamping force round the wire. A clamp device of this kind is not subject to problems in connection with repeated heating and cooling to as great an extent as the screw device, as long as the material in the clamp device is stable. Thus the clamp device does not require to be inspected to the same extent as a screw contact after the wire has been fitted in the clamp device. In connection with a clamp contact, however, a special tool has to be employed to bring the wire connection into contact therein and the present invention relates to a connecting tool for mounting a wire connection in a clamp contact. In a preferred embodiment the connecting tool can further remove the insulation from the wire in the same operation as that in which the wire is pushed into contact with the clamp device.

Of previously known solutions relating to similar connecting tools reference should especially be made to publication DE 2739247-B1 which concerns a tool for inserting an insulated electrical conductor in the clamp opening of a clamp element. As in the case of the present invention the solution in the said publication may also remove the insulation from a wire and subsequently push it into contact in a clamp device. In the said publication the insulated wire abuts against a displacement element in the tool, which element moves the insulated wire past two knife edges which cut away the insulation before the movable element further moves the stripped wire into connection in the contact clamp. In order to be able to employ the tool in the said publication the wire connection from which the insulation has to be removed has to be placed over the knife edges, in the area between the upper edge of the knife edges and the lower edge of the movable element. Furthermore, the tool will only have support against the contact clamp as long as the outer edges of the tool housing are located around the clamp and when the movable element passes out under the housing's lower edge the tool has little support and insufficient control round the clamp device. Moreover, it will not be possible to provide the lower end of the movable element with a corbelled shape which provides support round the clamp element as it will come into conflict with the clamp element when the movable element passes the lower edge of the tool's housing. Alternatively, the movable element may be provided with a corbelled shape which is adapted to the size of the clamp element, with the result that it will abut against and give support at the clamp element, but this will entail a larger dimension for the tool housing which in turn means that the tool housing cannot provide support round the clamp element in the initial part of the process where the movable element is pushed down against the clamp element. This in turn means poor support and control in the part of the application process where the insulation is removed from the wire connection inside the tool.

A further known solution within the same field is described in U.S. Pat. No. 5,099,570 which focuses to a greater extent on setting up the tool relative to the contact. In this case, however, the tool has a different function to some extent and the insulation is removed from the wire in a different way. The solution therefore addresses only parts of the problem which is solved in the present invention.

In comparison with previously known solutions as described above, the present invention provides a tool which both removes the insulation from a part of the wire connection and clamps it in position in a clamp device.

The device according to the present invention is so designed as to provide good control in connection with the clamp device in order to ensure that the wire connection is correctly pushed into position in the clamp device. Furthermore, the tool is designed in such a manner that the wire connection is held steady relative to the knife edges which cut the insulation and helps to secure the displacement of the insulation, thus preventing remaining insulation residue from being pressed down into the clamp device together with the stripped wire connection. Furthermore in an alternative embodiment the connecting tool may be designed in such a manner that the tool has two opposite ends which are adapted to different wire cross sections where the tool can easily be converted so that the desired end can be used. The connecting tool according to the present invention is further described in the introduction to the following independent claim with characterising features as indicated in the characterising part of the independent claim. Furthermore, different embodiments of the connecting tool are indicated in the following dependent claims.

The invention will now be described in further detail in relation to the figures, in which.

Figure 1:
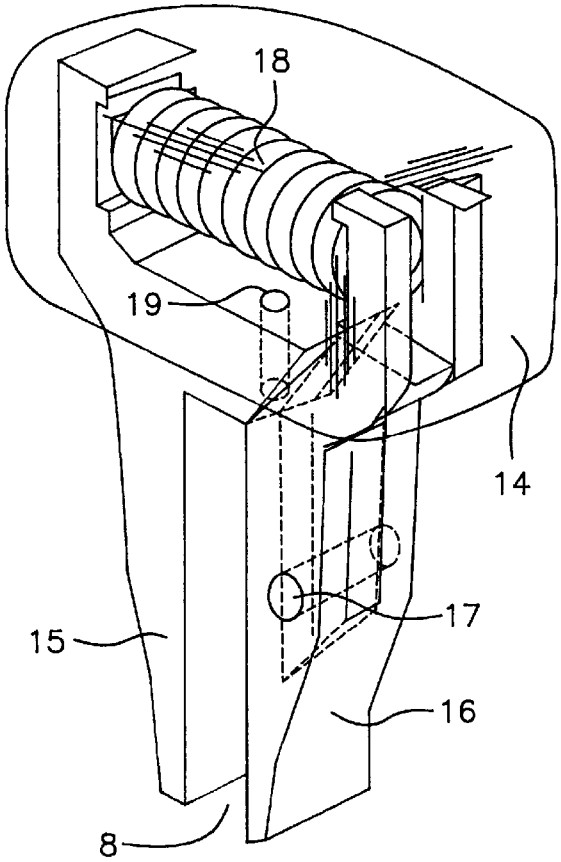
FIG. 1 is a cut-away view of the outer part of an embodiment of the present invention.
Figure 2:
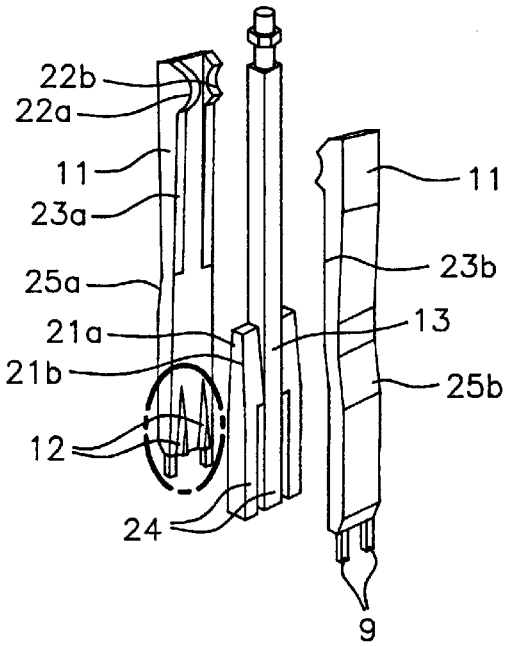
FIG. 2 illustrates the interior elements in the embodiment of the present invention illustrated in FIG. 1.
Figure 2A:
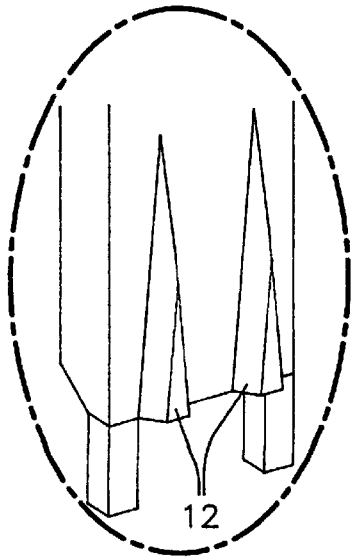
Figure 3:
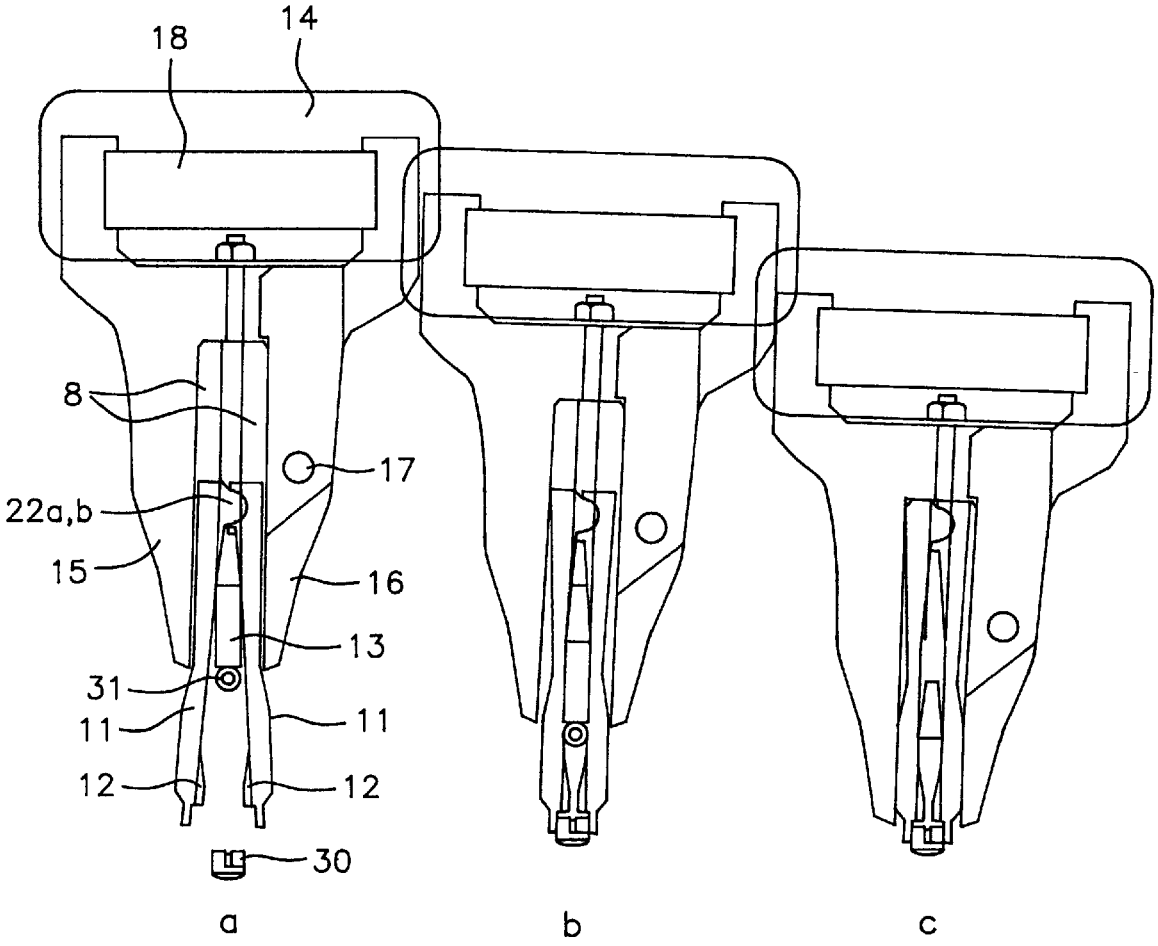

FIGS. 3*a–c* illustrate the termination order for terminating a wire connection in a clamp device by means of a connecting tool as illustrated in FIGS. 1 and 2.

Figure 4A:
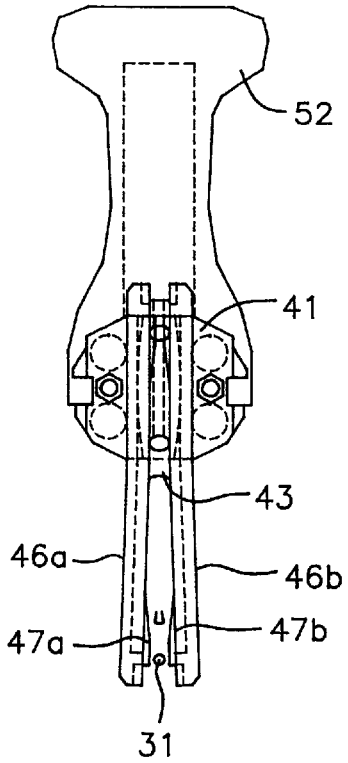
Figure 4B:
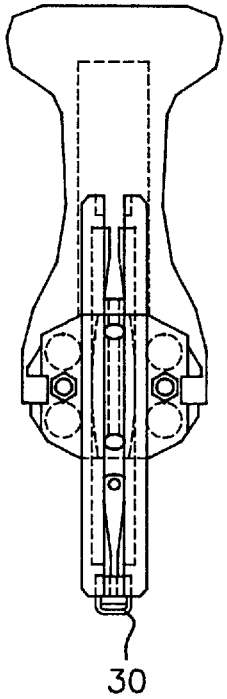
Figure 4C:
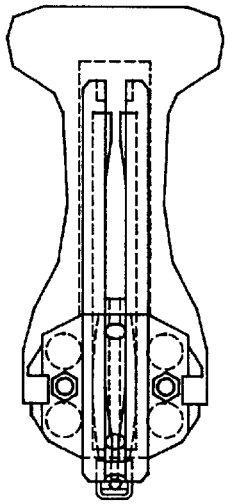
Figure 5:
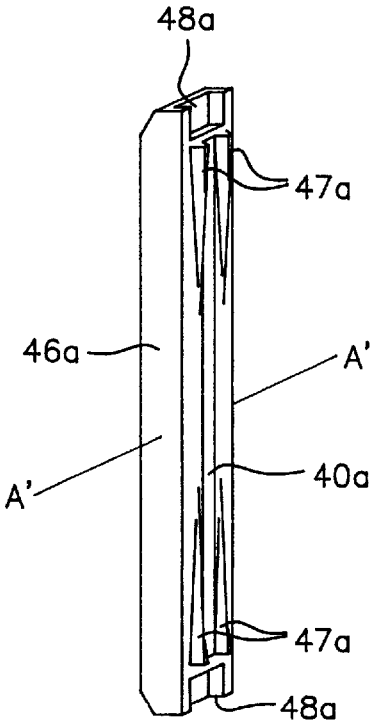

FIGS. 4*a–c* illustrate the termination order as in FIGS. 3*a–c* by means of a further embodiment of the present invention;

FIG. 5 illustrates a further embodiment of an interior element which is employed in the embodiment illustrated in FIGS. 4*a–c;*

Figure 6:
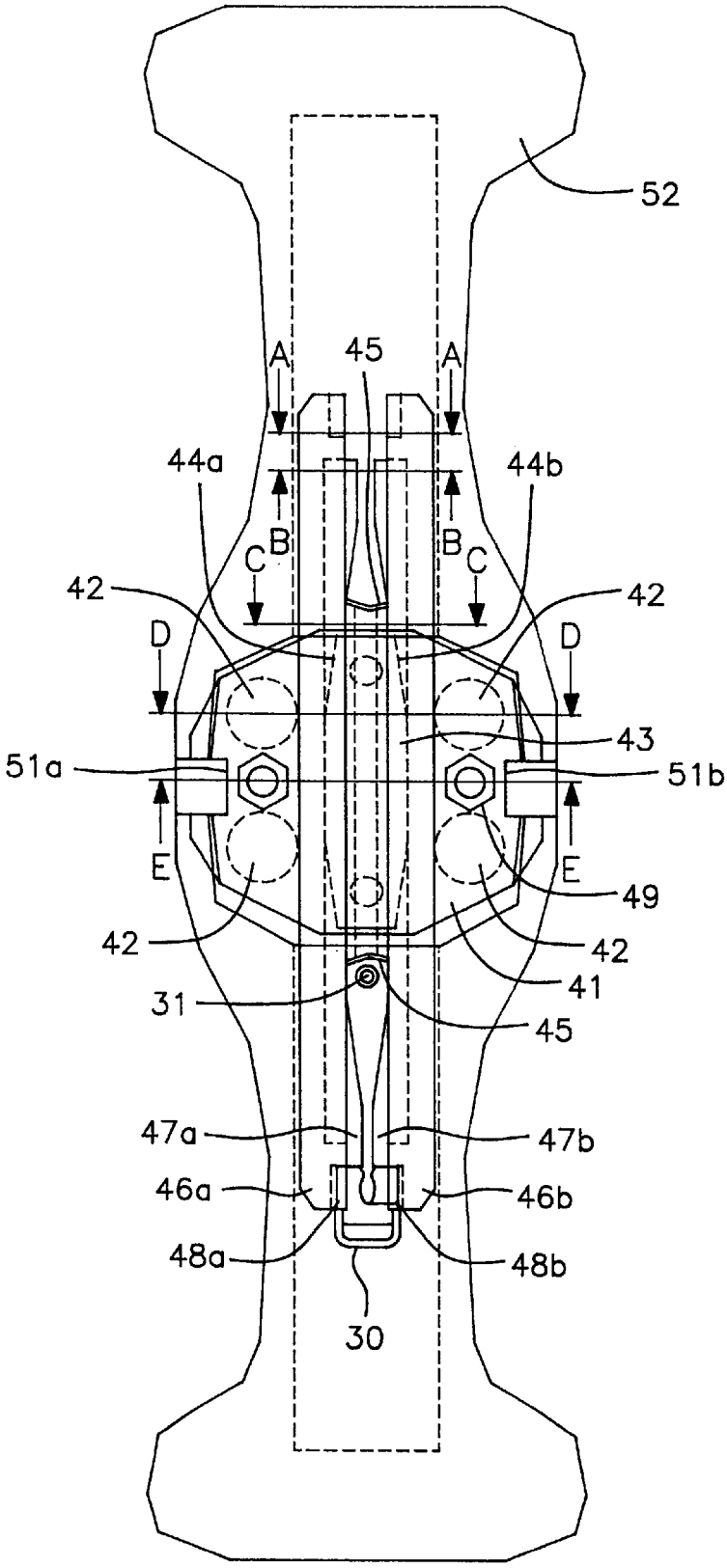
Figure 7:
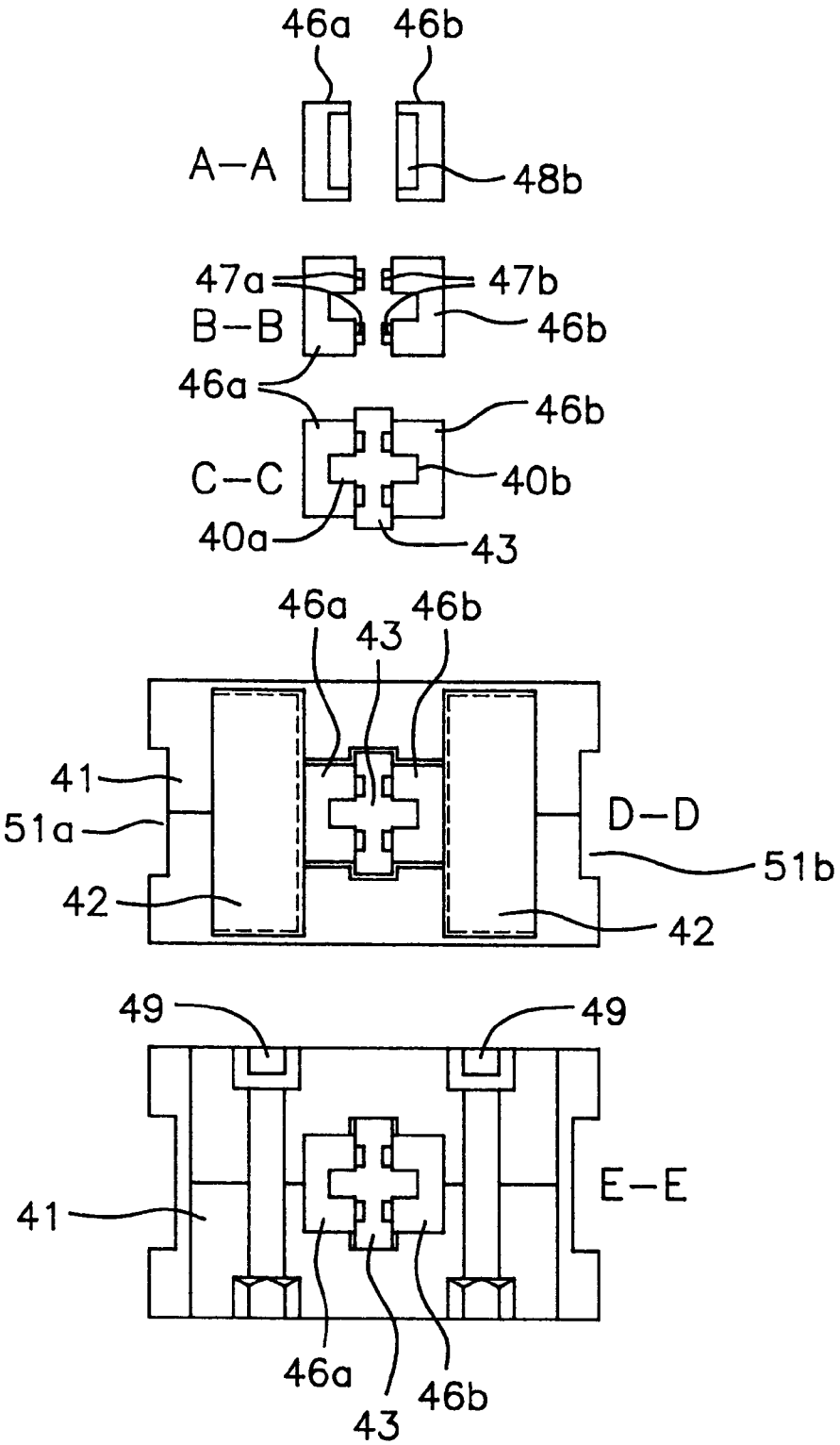
Figure 8:
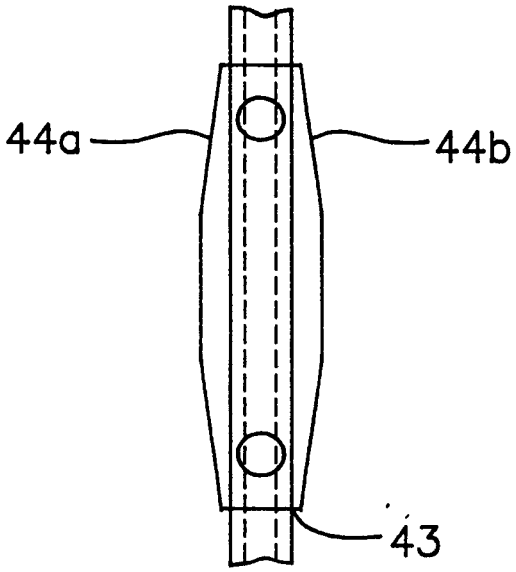
Figure 9:
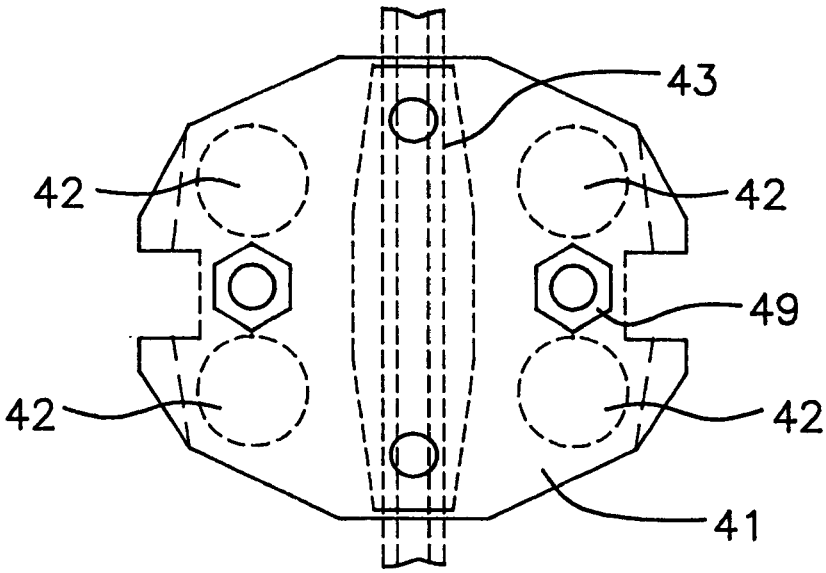
Figure 10:
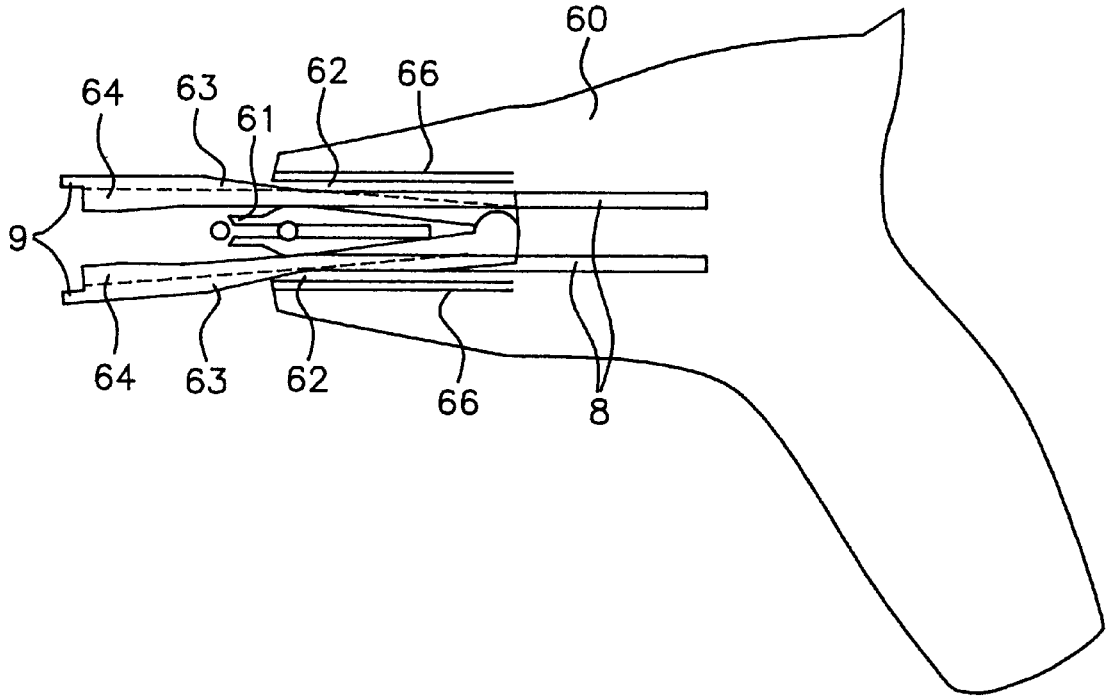
Figure 11:
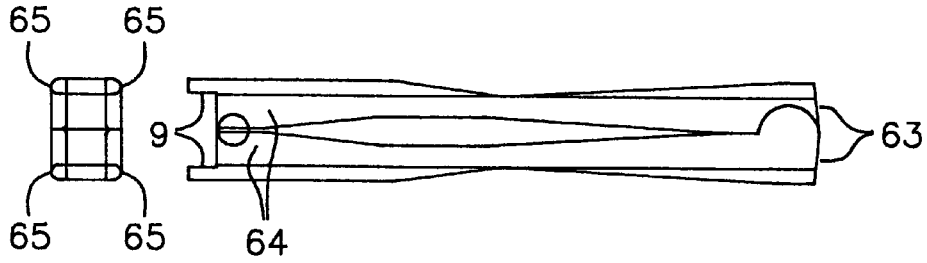
Figure 12:
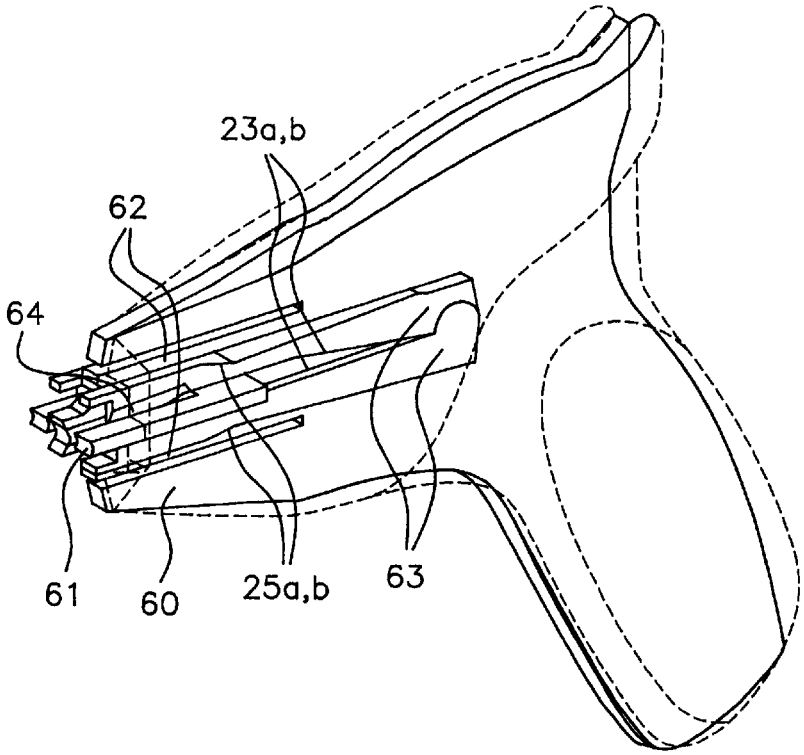
Figure 13:
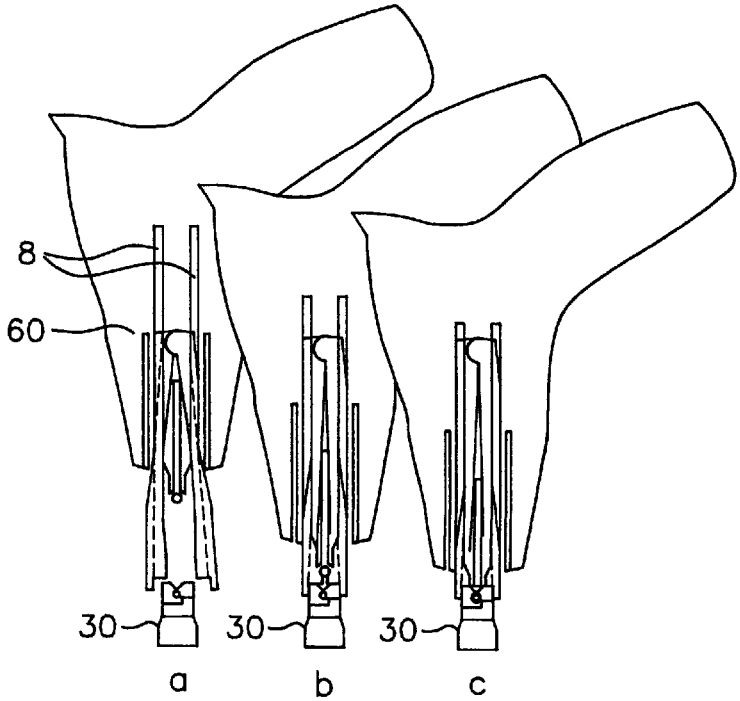

FIG. 6 illustrates a further embodiment of the connecting tool as used in FIGS. 4*a–c* with the interior element as illustrated in FIG. 5;

FIG. 7 illustrates various sections as indicated in FIG. 6;

FIG. 8 is a side view of an embodiment of the wire-pushing device;

FIG. 9 is a side view of an embodiment of the housing with the wire-pushing device;

FIG. 10 is a section viewed from the side of a further embodiment of the connecting tool according to the invention;

FIG. 11 is a view from the side and from the front of the knife bodies from the embodiment illustrated in FIG. 10;

FIG. 12 is a cut-away perspective view of a connecting tool as illustrated in FIGS. 10 and 11;

FIGS. 13*a–c* illustrate the termination sequence for a wire connection when using the connecting tool as illustrated in FIGS. 10–12.

FIG. 1 illustrates the outer part of an embodiment of the connecting tool according to the present invention, which outer part forms a housing for the internal elements which are illustrated in FIG. 2. Here the tool's housing consists substantially of two outer elements 15 and 16 which are connected to a bearing pin 17, with the result that the outer element 16 is rotatably mounted relative to the outer element 15 about the bearing pin 17. Between the outer elements 15 and 16 there is provided in the upper edge a spring or a spring element 18 which keeps the outer elements 15 and 16 at a specific distance apart when the connecting tool has to be used. Round the spring element and the upper section of the outer element 15 and 16 there is further indicated in FIG. 1 a handle or the like 14 which may be releasably mounted on the connecting tool in order to increase the ease of operation and to protect the spring and the upper section of the outer elements 15 and 16. The outer elements 15 and 16 further form between them an opening 8 which is adapted to receive the interior elements in the connecting tool as illustrated in FIG. 2.

The interior elements in the connecting tool as illustrated in FIG. 2 consist of a wire-pushing device 13 which is surrounded on two sides by knife bodies 11. At its upper end the wire-pushing device 13 is further provided with a connecting element, which is illustrated in FIG. 2 as a circular bolt which is employed to releasably connect the wire-pushing device 13 with one of the outer elements 15, 16 as illustrated in FIG. 1. The wire-pushing device 13 is thereby disposed in the opening 8 between the two outer elements 15 and 16 and by placing the bolt disposed at the upper end of the wire-pushing device 13 in the hole 19 in the outer element 15, the wire-pushing device 13 can be securely connected relative to the outer elements 15 and 16. There are further provided knife bodies 11 on each side of the wire-pushing device 13, between it and the outer elements 15 and 16. At their upper ends the knife bodies 11 are provided with complementarily shaped curved elements 22*a* and 22*b*, thus enabling the two knife bodies 11 to be rotated relative to each other about an imaginary axis through the curved elements 22*a* and 22*b* at the upper end of the knife bodies 11. At the lower end of the wire-pushing device 13 opposite the attachment point 19 in the outer element 15, the wire-pushing device is provided with slots 24 which are so designed and located that the knife segments 12 disposed on the knife bodies' 11 lower part can be received in the said slots 24. Thus the wire-pushing device 13 has a lower surface against the wire connection which has to be terminated by the connecting tool. In FIG. 2 there are further illustrated guide pins 9 at the lower end of the knife body 11 which, when the connecting tool is mounted over a clamp device, help to control the connecting tool and to hold it relative to the clamp device in such a manner that the wire-pushing device 13 pushes the wire connection to the correct position relative to the opening in the clamp device. The guide pins 9 can engage with openings between a clamp device 30 and a housing arranged round the clamp 30. In FIG. 2 the knife bodies 11 are further illustrated provided with externally sloping surfaces 25*a* and 25*b*. When the knife bodies 11 are pushed into the opening 8 between the outer elements 15 and 16 the sloping surfaces 25*a* and 25*b* will abut against the lower edge of the outer bodies 15 and 16 in the opening 8, thereby forcing the knife bodies 11 to rotate about the imaginary axis through the lugs 22*a* and 22*b* and thereby closing the lower end of the knife bodies 11 to a condition where the knife segments 12 move towards each other to a position where, by means of further movement, they will be received in the slots 24 in the wire-pushing device 13. Moreover, the surfaces 21*a*, 21*b* on the wire-pushing device together with the surfaces 23*a*, 23*b* on the inside of the knife bodies 11 will permit the movably arranged knife bodies 11 to be separated at their lower ends 9 when the knife bodies 11 are moved out into the opening 8. Inclined planes 44*a*, 44*b* alone may permit this as illustrated in FIG. 6.

In FIGS. 3*a–c* there is illustrated a termination sequence for a wire connection 31 from which the insulation has to be removed and terminated in a clamp device 30, by means of the connecting tool which is illustrated in FIGS. 1 and 2. In FIG. 3*a* the wire connection 31 is placed in the lower edge of the wire-pushing device 13 and as shown the knife bodies 11 are withdrawn from the opening 8 between the outer elements 15 and 16 to the point where the knife bodies' 11 outer sloping surfaces 25*a*, 25*b* are located below the lower end of the outer body 15 and 16. The knife bodies 11 thereby rotate about the imaginary axis which is formed by the complementarily shaped, curved elements 22*a*, 22*b* at the knife bodies' 11 upper end, with the result that the lower end of the knife bodies 11 is brought to a distance apart which enables the wire connection to pass between the knife segments 12 to abut against the wire-pushing device 13. The connecting tool is then placed over the clamp device 30, possibly with the control pins 9 engaged with the housing round the clamp device 30. FIG. 3*b* further illustrates how the knife bodies 11 are shifted to a deeper position in the opening 8 between the outer elements 15 and 16, with the result that the outer sloping surfaces 25*a* and 25*b* on the knife bodies 11 are located internally in the opening 8 between the outer elements 15 and 16. This assists in bringing the lower ends of the knife bodies 11 closer to each other and the opening between the lower ends of the knife bodies 11 is thereby closed round the clamp device 30. The lower areas of the knife bodies 11 are forced further together, the outer element 16 by means of its rotation about the axis 17 being subject to a spring force between the upper parts of the outer elements 15 and 16 in their upper end position. This means that the outer element 16 will be slightly "springy" compared to a solution where the outer elements 15 and 16 are rigid relative to each other with a constant spacing. In an alternative embodiment the outer elements 15 and 16 may nevertheless be securely connected whereupon the spring 18 will be unnecessary. The position illustrated in FIG. 3*b* will form the basis of a "stripping" of the wire connection 31 and in FIG. 3*c* the knife bodies 11 have been pushed completely into the opening 8 between the outer elements 15 and 16.

The knife segments 12 are thereby pushed past the wire connection 13 abutting against the lower part of the wire-pushing device 13. The knife segments 12 have thereby cut away and displaced the insulation round the wire connection 31 and the lower edges 9 of the knife bodies 11 are located controllingly and supportingly round the clamp device 30 with the result that when the lower edge of the wire-pushing device 13 passes the lower edge of the knife segments 12, the stripped part of the wire contact 31 is brought into contact in the clamp device 30. The connecting tool can then be removed from the clamp device, whereupon the knife bodies 11 are again withdrawn from the opening 8 between the outer elements 15, 16 to the position illustrated in FIG. 3*a*, whereupon a new wire connection 31 can be placed in the lower edge of the wire-pushing device 13 and the connecting tool can be mounted over a new clamp device in order to repeat the sequence.

In FIGS. 4*a–c* there is further illustrated a similar sequence to that in FIGS. 3*a–c*, where a further embodiment of the connecting tool as illustrated in FIGS. 5 to 9 is employed. The further embodiment, however, is based on the same principle, where the wire-pushing device 43 is securely mounted in a housing consisting of two halves 51*a* and 51*b* as illustrated in FIG. 6 and where the lower end edge of the wire-pushing device 45 abuts against a wire connection 31 which has to be brought into contact in a clamp device 30. As illustrated in FIG. 4*a* two knife bodies 46*a* and 46*b* are withdrawn from the opening in the housing and the handle, whereupon the inclined planes 44*a* and 44*b* on each side of the wire-pushing device 43 bring the two knife bodies 46*a* and 46*b* into a position where the lower edge of the two knife bodies has an enlarged spacing for the insertion of a wire connection 31 to abut against the lower part 45 of the wire-pushing device 43. FIG. 4*b* further illustrates how the connecting tool is positioned over a clamp device 30 with the result that, as illustrated in FIG. 5, the lower part of the knife bodies 46*a*, 46*b* at their cut-outs 48*a*, 48*b* are brought into a location around the clamp device 30 so that the connecting tool is in the correct position for terminating the wire connection 31 in the clamp device 30. In FIG. 4*b* moreover the two knife bodies 46*a* and 46*b* are pushed some distance into the housing 41 with the result that the knife bodies 46*a* and 46*b* abut against the vertical surfaces of the wire-pushing device 43, thus causing the knife bodies 46*a* and 46*b* to be oriented substantially vertically, their lower ends thereby being closed with the cut-outs 48*a* and 48*b* round the clamp device 30. In FIG. 4*c* it is further illustrated how the knife bodies 46*a* and 46*b* are moved in through the housing 41 and are located in the cavity in the handle 52. The wire section 31 which is located against the lower end 45 of the wire-pushing device 43 remains fixed while the knife bodies 46*a* and 46*b* are moved past the wire-pushing device 43, thereby bringing the knife segments 47*a* and 47*b* past the wire section 31. The knife segments 47*a* and 47*b* thereby cut off the insulation on the wire section 31. The knife bodies 46*a* and 46*b* are then moved past the wire section which is located against the lower part 45 of the wire-pushing device 43, thus causing the wire section 31 to be pushed into position in the opening in the clamp device 30. The sequence is thereby completed and the insulation is removed from the wire connection and it is brought into position in the clamp device 30. The connecting tool is then pulled up and the knife bodies 46*a* and 46*b* are withdrawn through the housing 41 to the position illustrated in FIG. 4*a* where a new wire connection 31 is brought into position under the lower side 45 of the wire-pushing device 43.

Furthermore in FIG. 5 there is illustrated one of the knife bodies 46*a*, 46*b* where it is clearly shown that the knife body is substantially symmetrically formed about its horizontal central portion A'—A'. It further clearly illustrates the recessed opening 48*a*, 48*b* which controls the connecting tool relative to the clamp device 30 together with the knife segments 47*a* and 47*b* which cut and possibly displace the insulation on the wire connection 31.

An embodiment of the connecting tool which is shown in use in the sequence in FIGS. 4*a–c*, employing the knife body as illustrated in FIG. 5 is shown in a vertical section from the side in FIG. 6. The housing 41 is symmetrical about the section marked E—E, thereby enabling the handle 52 to be mounted in two different orientations relative to the housing 41. Both of these orientations are indicated in FIG. 6, where the orientation which is used in FIGS. 4*a–c* is illustrated by a solid line, while an alternative orientation of the handle 52 is illustrated by a broken line in the lower edge of the housing 41. The symmetry in the housing 41 and the possibility of mounting the handle 52 in two different orientations provide the opportunity for different configurations of the knife bodies 46*a*, 46*b* at their respective opposite ends. Furthermore, the wire-pushing device can be designed substantially symmetrically about the section E—E, but with a differently shaped surface 45 for abutment against the wire connection. In the embodiment illustrated in FIG. 6 therefore it will be possible to adapt the connecting tool to two different wire thicknesses, for example 2½ $mm^2$ and 4 $mm^2$ which are standard wire dimensions for use in electrical installations. Thus a user can easily shift between the two sides by releasing the handle 52.

Furthermore, the sections in FIG. 6, which are marked A—A, B—B, C—C, D—D, E—E, are illustrated in FIG. 7 where it is clearly shown how the knife elements 46*a*, 46*b* are designed, especially in section C—C, in such a manner that they are controlled on each side of the wire-pushing device 43 in the housing 41. FIG. 8 further clearly illustrates how the wire-pushing device 43 is designed with sloping lateral surfaces 44*a*, 44*b* in the upper and lower areas which is instrumental in the knife bodies 46*a*, 46*b* achieving an inclined position relative to the tool's centre line when the knife bodies are withdrawn from the housing 41, and thereby opening at their lower end, thus enabling a wire connection to be inserted between the lower ends of the knife bodies 46*a*, 46*b*. The mounting of the wire-pushing device in the housing 41 is further illustrated in FIG. 9, where it is shown that the housing is symmetrical about its centre line, marked by the sectional line E—E in FIG. 6 and consists of two halves which are mounted, for example, with a screw connection as illustrated in section E—E in FIG. 7.

In FIG. 10 there is illustrated a further embodiment of a connecting tool according to the present invention. Here the housing 60 is provided with a wire-pushing device 61 in releasable or permanent connection. On each side of the wire-pushing device 61 there are openings 8 where there are movably installed knife bodies 63 with knife segments 64 which cut the insulation round the wire connection before it is brought into contact in the clamp device 30. As in the other figures, the knife bodies are provided with control pins 9 which can engage between the clamp device 30 and the housing around it as previously described. On each side of the knife bodies 63 there is formed a slot 66 in the housing 60 which provides spring elements 62 located against the knife bodies 63. Furthermore, in FIG. 12 there is a perspective view of the individual parts of the connecting tool as illustrated in FIG. 10. The inclined planes 23*a*, 23*b* and 25*a*, 25*b* are also indicated in FIG. 12 and have the same function as that previously described.

FIG. 11 further illustrates how the knife bodies 63 with the control pins 9 can engage with the openings 65 between the clamp device 30 and the housing round it. This is further reflected in FIG. 13 which illustrates the termination sequence when using an embodiment of the connecting tool as indicated in FIGS. 10, 11 and 12.

In the above different possible embodiments of the invention are illustrated, but the scope of the invention is only limited by the following claims and is therefore not limited to those embodiments which are illustrated or mentioned in the above description.

What is claimed is:

1. A device for removing insulation from a wire connection having a longitudinal direction (31) and for bringing it into contact in a connecting clamp (30), which device comprises a housing (15,16,41,60) provided with a wire-pushing device (13,43,61) against which the wire connection (31) abuts when the device is in use, characterized in that on two opposite sides of the wire-pushing device (13,43,61) the housing is provided with open cavities (8), in which cavities (8) there are movably arranged one or more movable bodies (11,46*a*,46*b*,63), on which movable bodies (11,46*a*,46*b*,63) there are subsequently mounted substantially in the wire connection's (31) longitudinal direction one or more knife segments (12,47*a*,47*b*,64).

2. A device for removing insulation from a wire connection (31) and for bringing it into contact in a connecting clamp (30), according to claim 1, characterized in that the wire-pushing device (13,43,61) is releasably arranged in the housing (15,16,41,60).

3. A device for removing insulation from a wire connection (31) and for bringing it into contact in a connecting clamp (30), according to claim 1, characterized in that the open cavities (8) in the housing (15,16,41,60) are through-going.

4. A device for removing insulation from a wire connection (31) and for bringing it into contact in a connecting clamp (30), according to claim 1, characterized in that the housing (15,16,41,60) on at least one side of the open cavities (8) is provided with one or more spring elements (62).

5. A device for removing insulation from a wire connection (31) and for bringing it into contact in a connecting clamp (30), according to claim 1, characterized in that the knife segments (12,47*a*,47*b*,64) are designed in such a manner that they cut through the insulation on a wire connection (31) and displace it in order to expose the wire connection's (31) conducting part.

6. A device for removing insulation from a wire connection (31) and for bringing it into contact in a connecting clamp (30), according to claim 1, characterized in that the wire-pushing device (13,43,61) mounted in the housing (15,16,41,60) is designed substantially complementarily to the elements (11,46*a*,46*b*,63) movably mounted on the side of the wire-pushing device (13,43,61).

7. A device for removing insulation from a wire connection (31) and for bringing it into contact in a connecting clamp (30), according to claim 1, characterized in that the movably mounted bodies (11,46*a*,46*b*,63) along their long sides against the inside of the housing's (15,16,41,60) cavity (8) have an outwardly sloping portion (25*a,b*) which brings the movable bodies (11,46*a*,46*b*,63) together when they are pushed into the housing (15,16,41,60).

8. A device for removing insulation from a wire connection (31) and for bringing it into contact in a connecting clamp (30), according to claim 1, characterized in that along its long sides against the movably mounted bodies (11,63) the wire-pushing device (13,61) is provided with inclined planes (21*a*,21*b*) increasing towards the wire-pushing device's (13,61) end piece which abuts against the wire connection (31), which inclined planes (21*a*,21*b*) together with inclined planes (23*a*,23*b*) mounted on the inside of the movably arranged bodies (11,63) permit the movably arranged bodies (11,63) to be separated at their lower ends (9) when the movably arranged bodies (11,63) are moved out into the openings (8).

9. A device for removing insulation from a wire connection (31) and for bringing it into contact in a connecting clamp (30), according to claim 1, characterized in that a front part of the wire-pushing device (13,43,61) is designed with a curved portion (45) for co-operation with the wire connection (31).

10. A device for removing insulation from a wire connection (31) and for bringing it into contact in a connecting clamp (30), according to claim 1, characterized in that front ends (9) of the movable bodies **(11,46*a*,46*b*,63) are designed in such a manner that they tightly enclose a connecting clamp (30)**.

11. A device for removing insulation from a wire connection (31) and for bringing it into contact in a connecting clamp (30), according to claim 1, characterized in that front ends (9) of the movable bodies **(11,46*a*,46*b*,63) are designed in such a manner that they engage with a housing disposed round the connecting clamp (30)**.

12. A device for removing insulation from a wire connection (31) and for bringing it into contact in a connecting clamp (30), according to claim 1, characterized in that in the housing (41), on each side of the wire-pushing device (43) there are mounted one or more rollers or bearings (42) which support the movable bodies **(46*a*,46*b*)**.

13. A device for removing insulation from a wire connection (31) and for bringing it into contact in a connecting clamp (30), according to claim 1, characterized in that the housing (41) is symmetrically shaped, thus enabling a handle (52) to be mounted over each of the housing's (41) ends.

14. A device for removing insulation from a wire connection (31) and for bringing it into contact in a connecting clamp (30), according to claim 1, characterized in that the movable bodies **(46*a*,46*b*) are approximately symmetrically shaped about a transverse axis (A'—A') and the distance between the knife segments (47*a*,47*b*) is adapted at each end of the movable bodies (46*a*,46*b*)** to different wire cross sections or insulation thicknesses.

* * * * *